US005626161A

United States Patent [19]

Lin et al.

[11] Patent Number: 5,626,161

[45] Date of Patent: May 6, 1997

[54] MULTIPLE-FOLD AUTOMATIC UMBRELLA WITH SIMPLIFIED RELIABLE CONTROL MEANS

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 639,696

[22] Filed: Apr. 29, 1996

[51] Int. Cl.[6] ..... A45B 25/14

[52] U.S. Cl. ..... 135/24; 135/37; 135/20.3

[58] Field of Search ..... 135/22, 23, 24, 135/28, 25.4, 25.41, 31, 25.1

[56] References Cited

U.S. PATENT DOCUMENTS

| | | | |
|---|---|---|---|
| 3,729,012 | 4/1973 | Weber | 135/22 X |
| 4,986,294 | 1/1991 | Wu | 135/22 |
| 5,178,174 | 1/1993 | Wu | 135/24 X |
| 5,390,686 | 2/1995 | Lin et al. | 135/24 |
| 5,441,065 | 8/1995 | Lin et al. | 135/24 |
| 5,492,140 | 2/1996 | Lin et al. | 135/22 X |
| 5,505,222 | 4/1996 | Lin et al. | 135/24 |

*Primary Examiner*—Lanna Mai

[57] ABSTRACT

A multiple-fold automatic umbrella includes: a control device having a push button slidably held in the grip for controlling the opening and closing of the umbrella, a slotted arm member secured to the push button having a pair of sockets formed in the slotted arm member, a shortened upper latch having a pair of lugs engageable with the pair of sockets for unlocking a folded telescopic shaft of the umbrella when depressing the push button for opening the umbrella, and a convex spring plate secured to a plug fixed into an inner tube of the shaft having a pair of flaps disposed on two opposite side portions of the convex spring plate for slidably holding a locking head of an umbrella-closing controller to be locked in the inner tube for a reliable folding operation of the umbrella.

2 Claims, 8 Drawing Sheets

MULTIPLE-FOLD AUTOMATIC UMBRELLA WITH SIMPLIFIED RELIABLE CONTROL MEANS

BACKGROUND OF THE INVENTION

This application is an improvement of U.S. Pat. No. 5,505,222 entitled "Multiple-fold Automatic Umbrella with Simplified Control Means" (hereinafter defined as "Prior Art") by the same inventors of this application. However, the prior art patent has the following drawbacks:

1. The upper latch 52 of the control means 5 includes a pair of bifurcated arm members 523, each arm member 523 made as a thin plate to possibly weaken its strength.

2. The sloping spring portion 580 of the convex spring plate 58 for biasing the locking head 551 to be locked on the detent protrusion 111*a* in the inner tube 11 is lacking of a pair of side walls disposed on two opposite side portions of the sloping spring portion 580 for slidably holding the locking head 551 when folding the umbrella, thereby affacting a reliability for folding the umbrella.

3. For fixing the two spring ends 581, 582 deeply into the narrower inner tube 11, it will increase the assembly complexity and production cost.

The present inventors have found the drawbacks of the prior art patent and invented the present multiple-fold automatic umbrella with simplified reliable control means.

SUMMARY OF THE INVENTION

The object of the present invention is to provide a multiple-fold automatic umbrella including: a control device having a push button slidably held in the grip for controlling the opening and closing of the umbrella, a slotted arm member secured to the push button having a pair of sockets formed in the slotted arm member, a shortened upper latch having a pair of lugs engageable with the pair of sockets for unlocking a folded telescopic shaft of the umbrella when depressing the push button for opening the umbrella, and a convex spring plate secured to a plug fixed into an inner tube of the shaft having a pair of flaps disposed on two opposite side portions of the convex spring plate for slidably holding a locking head of an umbrella-closing controller to be locked in the inner tube for a reliable folding operation of the umbrella.

DETAILED DESCRIPTION

Figures 1, 1A:
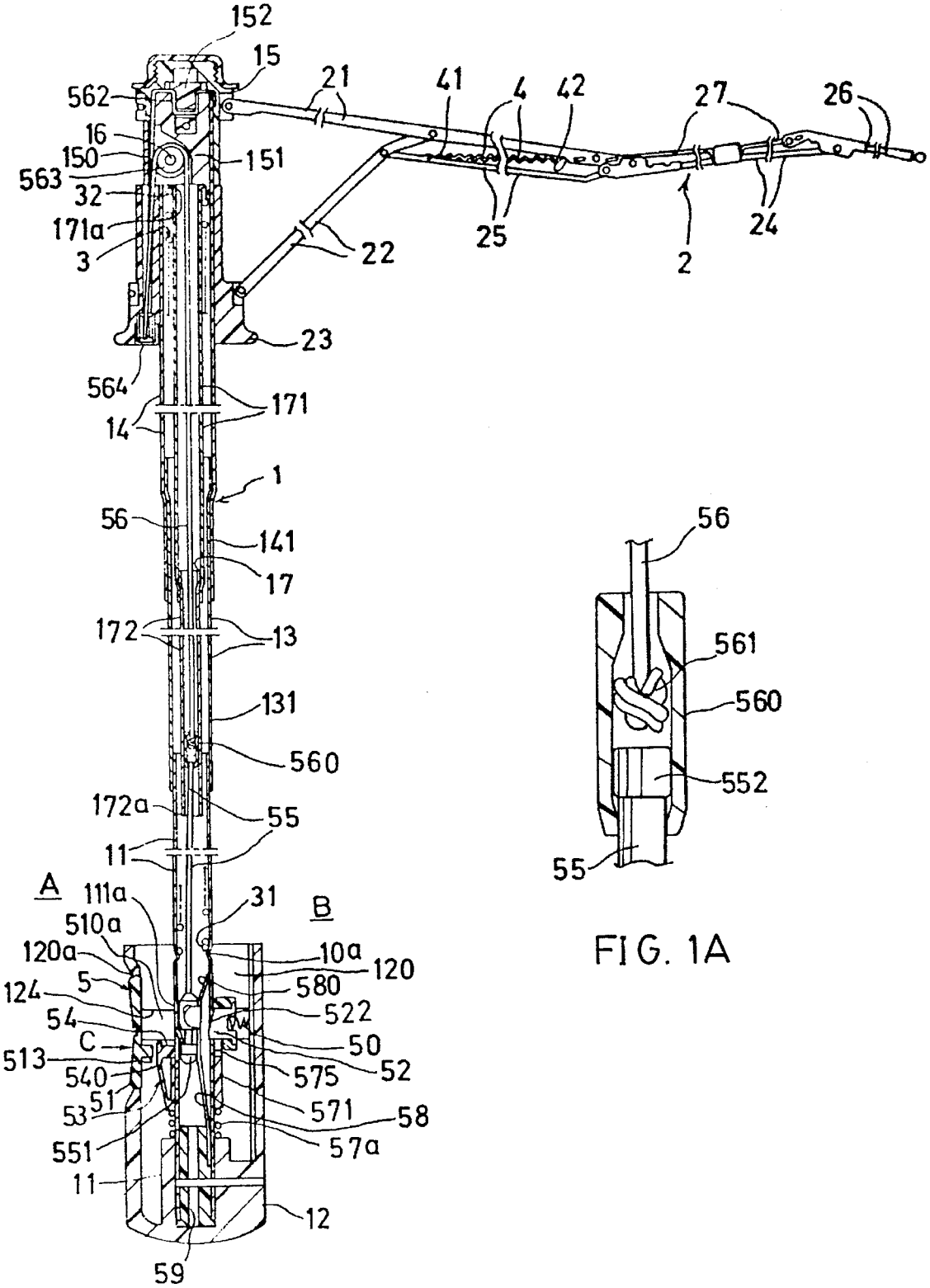
FIG. 1 shows an opened umbrella in accordance with the present invention.
FIG. 1A is an enlarged view showing the coupling of the drag rod and the drag rope.

As shown in FIGS. 1–8, the present invention comprises: a central shaft means 1, a rib assembly 2, an opening spring 3, a plurality of closing springs 4, and a control means 5. The elements and description of this application are mostly repeated from the prior art of U.S. Pat. No. 5,505,222.

The central shaft means 1 includes: an inner (or lower) tube 11, a grip 12 secured to a lower tube portion of the inner tube 11, a middle tube 13 slidably held on an outer and upper side of the inner tube 11, an outer (or upper) tube 14 slidably held on an outer and upper side of the middle tube 13, an upper notch 15 secured on a top portion of the outer tube 14, and a central sleeve set 17 including an inner sleeve section 172, and an outer sleeve section 171 telescopically coupled with the inner sleeve section 172 having an uppermost sleeve portion 171*a* of the outer sleeve section 171 contiguous to an upper portion of the outer tube 14.

The rib assembly 2 includes: a top rib 21 having an inner rib portion of the top rib 21 pivotally secured to the upper notch 15 of the central shaft means 1, an inner stretcher rib 22 having an inner rib portion of the inner stretcher rib 22 pivotally secured to a lower runner 23 which is slidably held on the outer tube 14 and having an outermost rib end of the inner stretcher rib 22 pivotally connected with a middle portion of the top rib 21, an intermediate rib 24 having an inner rib end of the intermediate rib 24 pivotally connected with an outermost rib end of the top rib 21 and having an innermost rib end of the intermediate rib 24 pivotally connected with an intermediate connecting rod 25 of which an inner rod end of the intermediate connecting rod 25 is pivotally secured to an outer rib portion of the inner stretcher rib 22, and a rear rib 26 having an inner rib portion of the rear rib 26 pivotally connected with an outer rib portion of the intermediate rib 24 and having an innermost rib end of the rear rib 26 pivotally connected with a spring rod 27 of which an inner rod end of the spring rod 27 is pivotally connected with an outer rib portion of the top rib 21. Other rib mechanisms can be modified.

The opening spring 3 for opening an umbrella of this invention has a lower spring end 31 retained on a lower tube portion 10*a* of the inner tube 11, and an upper spring end 32 retained on a bottom portion of an inner block 151 inserted in an upper portion of the outer tube 14, the opening spring 3 slidably disposed about the central sleeve set 17.

Each closing spring 4 of the plurality of the closing springs 4 has an inner spring end 41 of the closing spring 4 secured to an inner portion of the intermediate connecting rod 25, and an outer spring end 42 of the closing spring 4 secured to an outer rib portion of the top rib 21. The closing spring 4 is provided for operatively closing an umbrella from its opened state by an elastic energy stored when opening the umbrella. Other locations for installing the closing spring 4 on the rib means 2 may be modified.

The control means 5 includes: a push button 51 resiliently held in a button hole 120*a* formed in the grip 12, an upper latch 52 slidably held in a slotted arm member 510 perpendicularly protruding from a middle button portion of the push button 51 from a first side A of the central shaft means 1 towards a second side B of the shaft means 1 and operatively depressed by the push button 51 for opening the umbrella, a closing controller 53 having a lower latch 54 resiliently held in the grip 12 and operatively depressible by the push button 51 for inwardly pushing a locking head 551, which is secured with a drag rod 55 coupled to a drag rope 56 which is linked through the lower runner 23 to an upper portion of the outer tube 14, for disengaging the locking head 551 from a detent protrusion 111*a* formed in a lower portion of the inner tube 11, thereby allowing each said closing spring 4 to be restored to release its pre-stored elastic energy for closing the umbrella from an opened state, with the lower latch 54 resiliently secured to an anti-false false operation safety means 57 which is lowered by the outer and middle tubes 14, 13 when closing the umbrella to prevent a false depression of the closing controller 53 as depressed by the push button.

The slotted arm member 510 of the button 51 may be slidably held in a groove 124 transversely formed in the grip 12.

Figure 4:
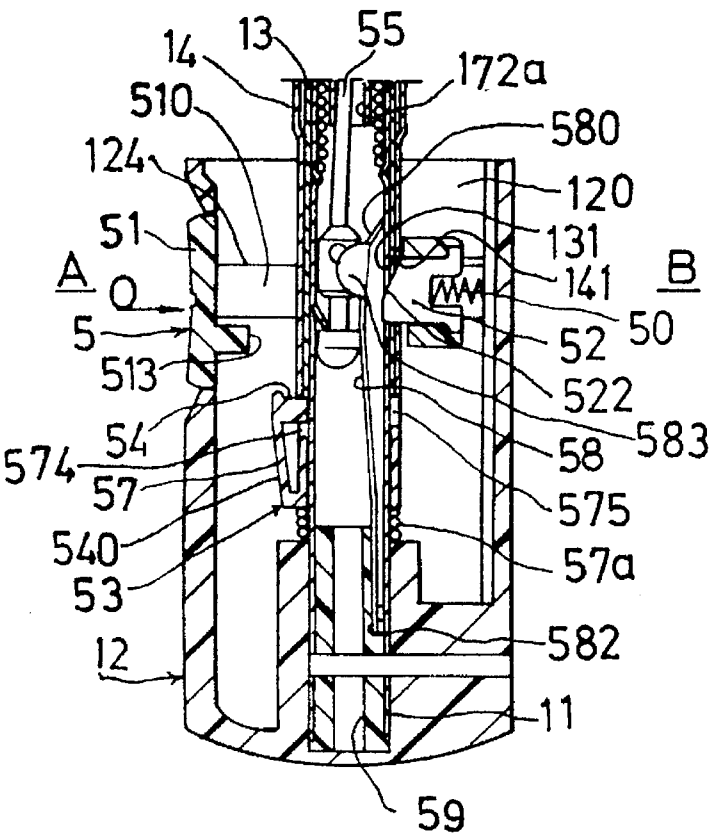
FIG. 4 is a sectional drawing of the grip of the present invention as shown in FIG. 3.
Figure 7:
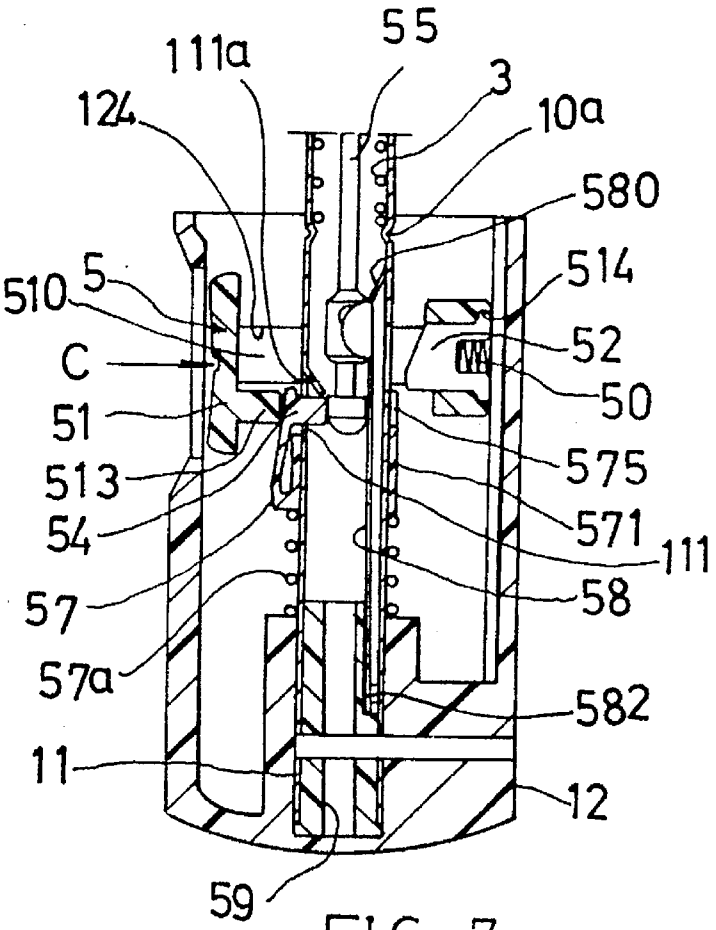
FIG. 7 shows a depression of the push button from FIG. 6 for closing the umbrella of the present invention.

The upper latch 52 includes: a pair of lugs 523*a* protruding from the sloping latch portion 522 adjacent to the second side B of the shaft means 1 to be engaged with the two sockets 514 which are formed in an inner portion of the slotted arm member 510 of the push button 51, and the upper latch 52 having a spring notch 524*a* formed at the second side B of the shaft means 1 to be resiliently urged towards the first side A of the shaft means 1 by a restoring spring 50 retained in the grip 12 adjacent to the second side B of the shaft means 1 to be engageable with a lower hole 141 formed in the outer tube 14, and a lower hole 131 formed in the middle tube 13 for locking an umbrella under a closed state (FIG. 4).

The push button 51 has the slotted arm member 510 formed with a central hole 510*a* in a central portion of the slotted arm member 510 for downwardly passing a bottom tube portion of each outer tube 14 and middle tube 13 when folding the central shaft means 1 for closing the umbrella (FIG. 4), a latch slot 515 formed through an inner end portion of the slotted arm member 510 adjacent to the second side B for slidably holding the sloping latch portion 522 in the latch slot 515 and a central thrusting block 513 formed on a central portion inside the push button 51 and protruding inwardly towards the second side B of the shaft means 1.

Upon an inward depression of the push button 51 to allow the sockets 514 512 of the slotted arm member 510 of the push button 51 to retract the two lugs 523*a* for disengaging the sloping latch portion 522 from the lower holes 141, 131 of the outer, and middle tubes 14, 13, the umbrella will be opened because the tubes of the shaft means 1 are resiliently tensioned by the opening spring 3.

Figure 6:
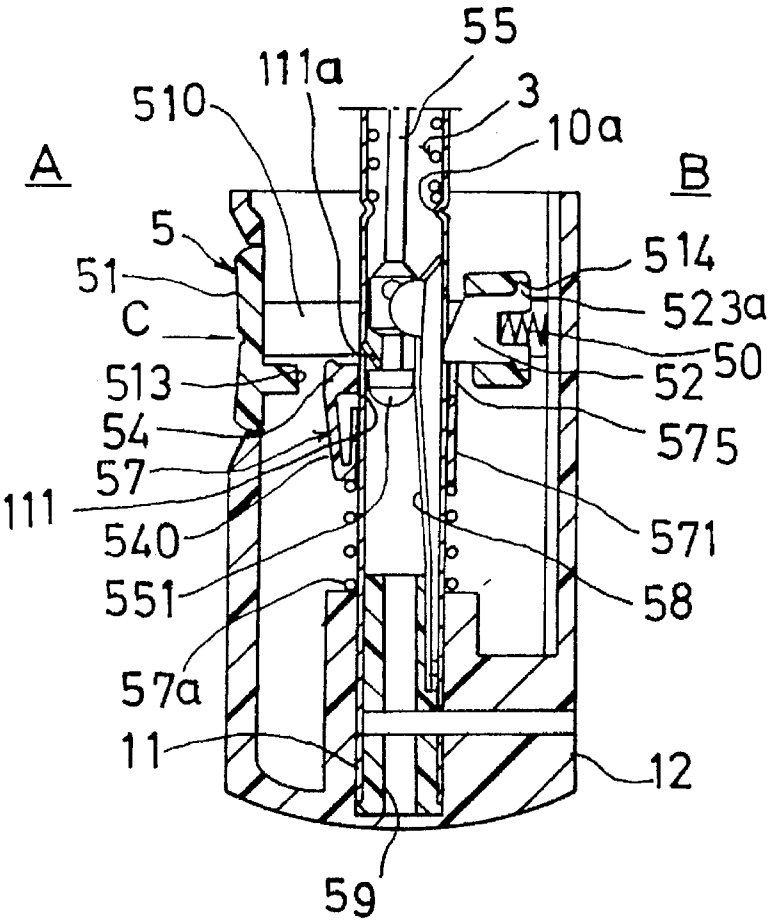
FIG. 6 shows the grip of the present invention when releasing the push button from FIG. 5.
Figure 8:
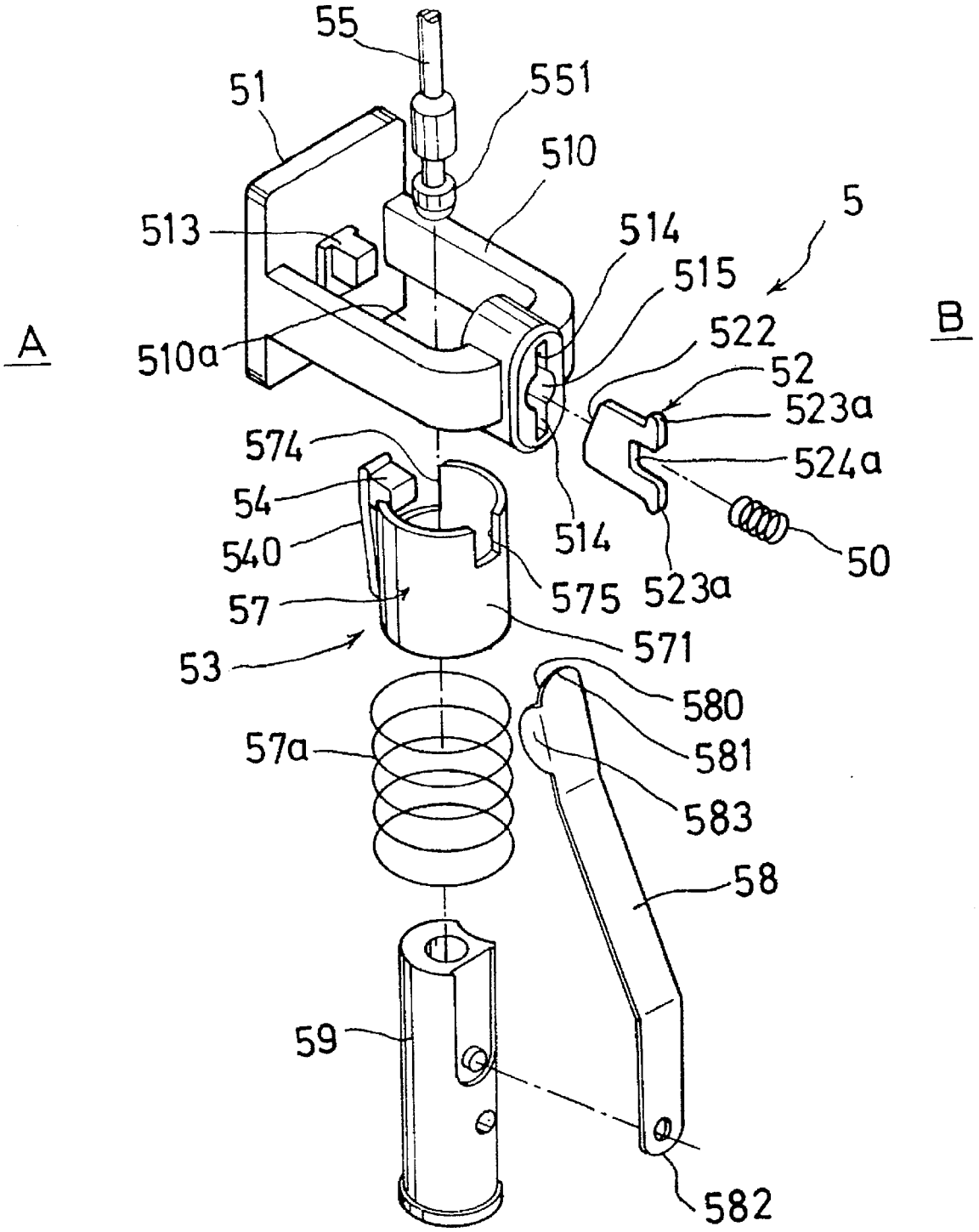
FIG. 8 is an exploded view showing the elements of the control means of the present invention.

The closing controller 53 includes: the lower latch 54 resiliently secured to the anti-false operation safety means 57 by a spring plate 540 and resiliently raised upwardly as urged by a tension spring 57*a* of the safety means 57 to be positioned in between a central thrusting block 513 of the push button 51 and a locking head 551 secured with the drag rod 55 when opening the umbrella as shown in FIG. 6, with the central hole 510*a* in the slotted arm member 510 allowing an upwardly moving of the lower latch 54 as urged by the cylinder 571 and tension spring 57*a* after opening the umbrella to extend the outer and middle tubes 14, 13 upwardly as shown in FIG. 6, whereby upon depression of the push button to inwardly thrust the central thrusting block 513 formed on the central portion inside the button 51, the locking head 551 will be disengaged from the detent protrusion 111*a* in the inner tube 11 for closing an umbrella from an opened state.

The detent protrusion 111*a* is directly punched inwardly from a lower portion of the inner tube 11 for engaging the locking head 551 when closing the umbrella as sidewards biased towards the first side A of the shaft means 1 by a convex spring plate 58 formed in the grip 12 at the second side B of shaft means 1.

The drag rod 55 has a lower rod end secured to the locking head 551 and an upper rod end 552 pivotally secured in a coupling sleeve 560, with an inner rope end 561 of the drag rope 56 secured in the coupling sleeve 560, and with the drag rod 55 slidably held in the inner sleeve section 172 of the central sleeve set 17.

The drag rope 56 includes: the lower rope end 561 coupled to the drag rod 55 by the coupling sleeve 560, an upper rope end 562 fixed to a top portion 152 of the outer tube 14 and in the upper notch 15, an upper guiding roller 563 rotatably mounted by a upper pivot 16 in the inner block 151 secured in a top portion of the outer tube 14 and in the upper notch 15 for slidably guiding the drag rope 56 from inside the outer tube 14 and the central sleeve set 17 telescopically held within the inner tube 11, the middle tube 13, and the outer tube 14 through the upper guiding roller 563 towards a lower guiding roller 564 through a rope passage 150 formed in the upper notch 15, the rope 56 with an upper rope section passing through the lower guiding roller 564 to have the upper rope end 562 fixed to the top portion 152 of the outer tube 14 and inside the inner block 151.

The anti-false operation safety means 57 includes: a cylinder 571 slidably disposed around a lower portion of the inner tube 11 and resiliently rested on a tension spring 57*a* retained in a lower portion of the grip 12, the cylinder 571 having a spring plate 540 protruding upwardly to connect the lower latch 54 which is downwardly moved when closing the umbrella for preventing a false operation of the closing controller 53 when the central shaft means 1 is folded to lower the outer and middle tubes 14, 13 to allow a bottom end of each middle tube 13 and outer tube 14 to downwardly press the lower latch 54, the cylinder 571 and the tension spring 57*a* downwardly for restoring the spring energy of the tension spring 57*a* as shown in FIG. 4 whereby the outer and middle tubes 14, 13 are locked by engaging the sloping latch portion 522 with the lower holes 141, 131 of the tubes 14, 13, a first slot 574 notched in a first side of the cylinder for an inward movement of the lower latch 54 connected to the cylinder 571 by the spring plate 540 adjacent to the first side A of the shaft means 1 when depressed by the push button for closing the umbrella, and a second slot 575 formed at a second side of the cylinder for slidably moving of the safety means 57 on the inner tube 11 as shown in FIGS. 4, 6 without being obstructed by the sloping latch portion 522.

Figure 3:
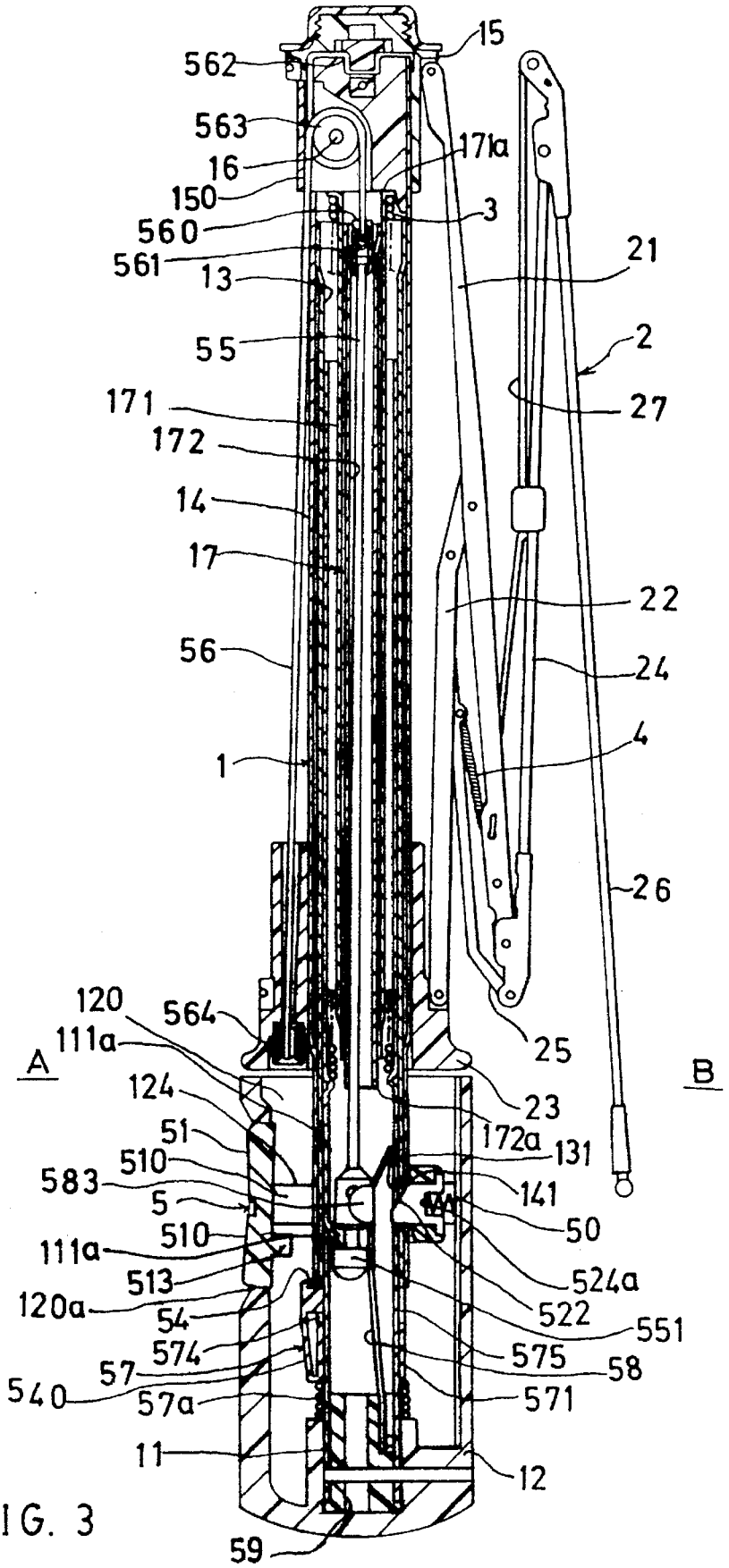
FIG. 3 shows a folded umbrella when re-set from FIG. 2.
Figure 5:
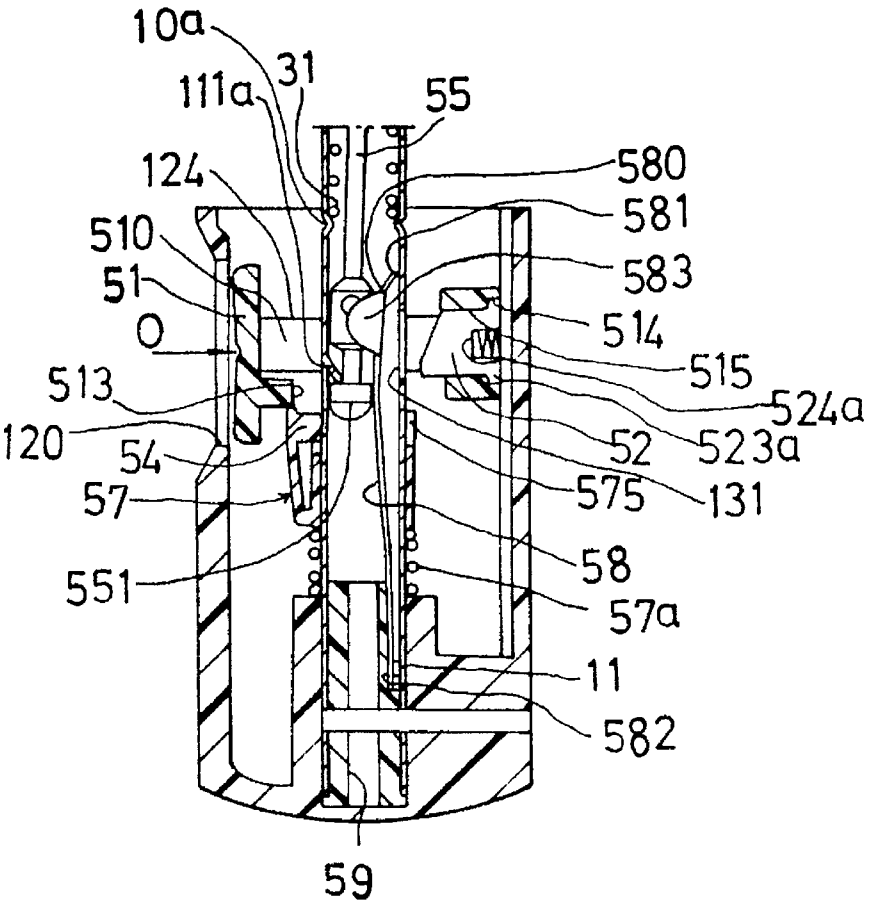
FIG. 5 is an illustration of the present invention when depressing the push button of the control means for opening the umbrella.

The convex spring plate 58 has a lower spring end 582 fixed to a plug 59 inserted in the inner tube 11 inserted into the inner hole 120 of the grip 12, a sloping spring portion 580 inclined downwardly from an upper spring end 581 to an axis of the shaft means 1 for biasing the locking head 551 to be locked on the detent protrusion 111*a* formed in the inner tube 11 adjacent to the first side A of the shaft means 1 when closing the umbrella (FIG. 3). Two flaps 583 are disposed on two opposite side portions of the spring plate 58 for slidably holding the locking head 581 during the operation.

When opening the umbrella of the present invention as shown from FIG. 3 to FIG. 1, the push button 51 is depressed (O) to allow the two sockets 514 of the slotted arm member 510 to force the two lugs 523*a* of the latch 52 inwardly to disengage the sloping latch portion 522 from the holes 141, 131 formed in the tubes 14, 13 of the shaft means 1 to release the opening spring 3, which is previously compressed when re-setting the umbrella for storing the elastic energy of the opening spring as shown in FIG. 3, to extend the tubes 14, 13, 11 and open the ribs of the rib assembly 2 for opening the umbrella. The closing springs 4 are also tensioned to store their restoring elastic energy by the opening operation of the umbrella as effected by the opening spring 3.

Figure 2:
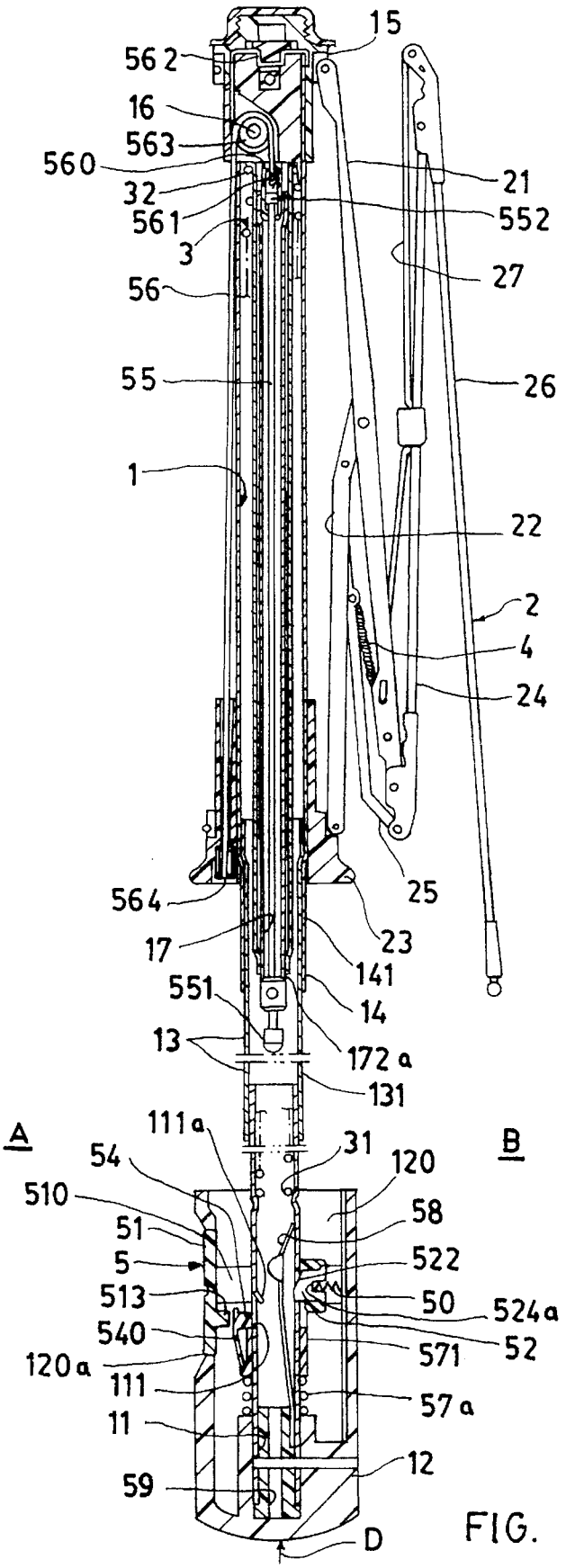
FIG. 2 shows a closed umbrella of the present invention when folded from FIG. 1.

When closing the umbrella from FIG. 1 to FIG. 2, the push button 51 is depressed (C) to allow the central thrusting block 513 of the button 51 to force the lower latch 54 of the closing controller 53 towards the second side B of shaft means 1 to disengage the locking head 551 from the detent protrusion 111*a* formed in the inner tube 11 to allow a downward movement of the runner 23 required for closing the umbrella, and the closing springs 4 will restore to lower the runner 23 to retract the ribs of the rib assembly 2 and fold the tubes 14, 13, 11 as shown in FIG. 2. The locking head 551 will then be raised to be stopped at a lower sleeve portion 172*a* of the sleeve set 17. The lower latch 54 and the cylinder 571 will be moved upwardly as upwardly urged by the tension spring 57*a* to be positioned between the thrusting block 513 and the locking head 551 after opening the umbrella and raising the tubes 14, 13 (FIG. 6), thereby causing no obstruction for the inward depression of the central thrusting block 513 of the button 51 for a normal closing operation of the umbrella (from FIG. 1 to FIG. 2).

For re-setting the folded or closed umbrella to store an elastic energy of the opening spring 3, the grip 12 may be depressed (D) towards a tip portion of the umbrella (FIG. 2 to FIG. 3) for compressing the spring 3 ready for next opening use.

The present invention may be used for an automatic umbrella having triple folds or multiple folds.

The present invention is superior to U.S. Pat. No. 5,505,222 with the following advantages:

1. The upper latch 52 is shortened and simplified to be a pair of lugs 523*a* diverging from the sloping latch portion 522 for simplifying the production, but not affecting its strength.

2. The spring plate 58 having a pair of flaps 583 will ensure a "holding" of the locking head 551 to be locked on the detent protrusion 111*a* in the inner tube 11 for a reliable folding operation when closing the umbrella.

3. The spring plate 58 can be prefixed on the plug 59 which is then inserted into the inner tube to facilitate the assembly in making the umbrella.

Figure 10:
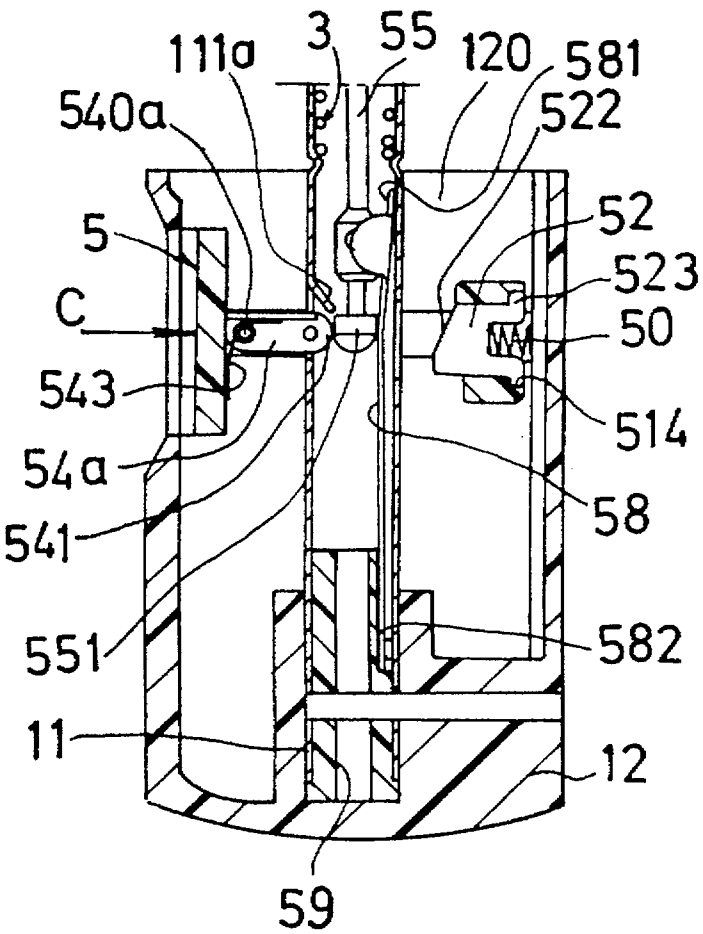
FIG. 10 shows an instant step when depressing the button for closing the umbrella.
Figure 9:
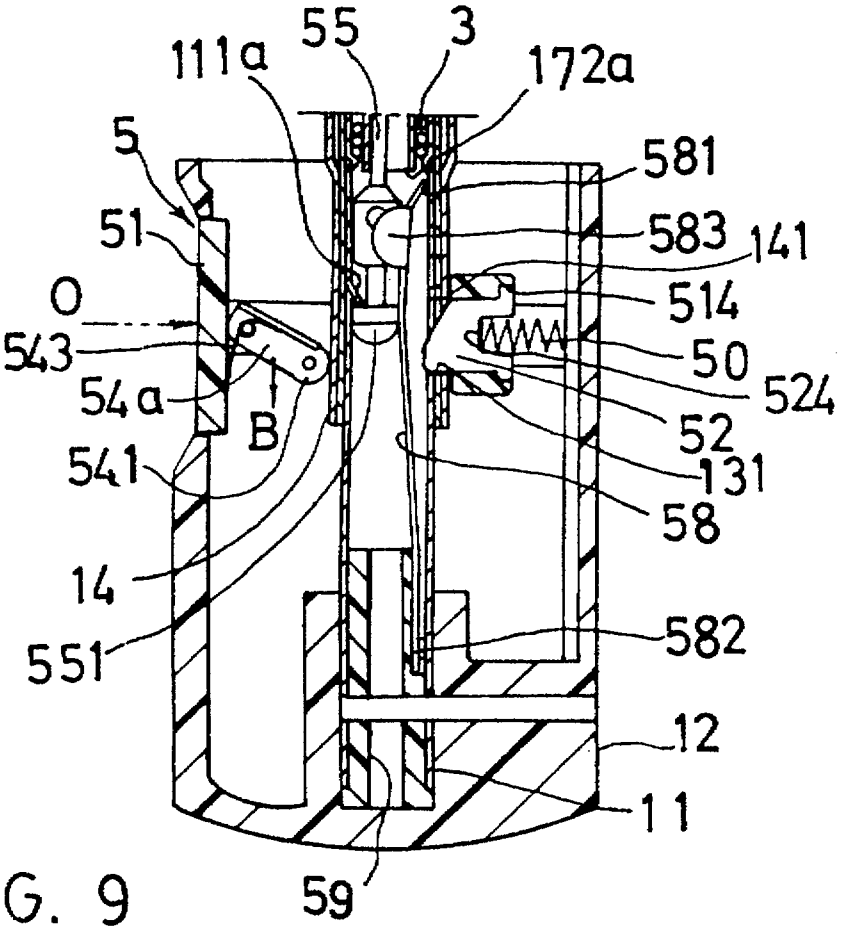
FIG. 9 shows the grip of another preferred embodiment of the present invention when reset for storing energy of the opening spring.
Figure 11:
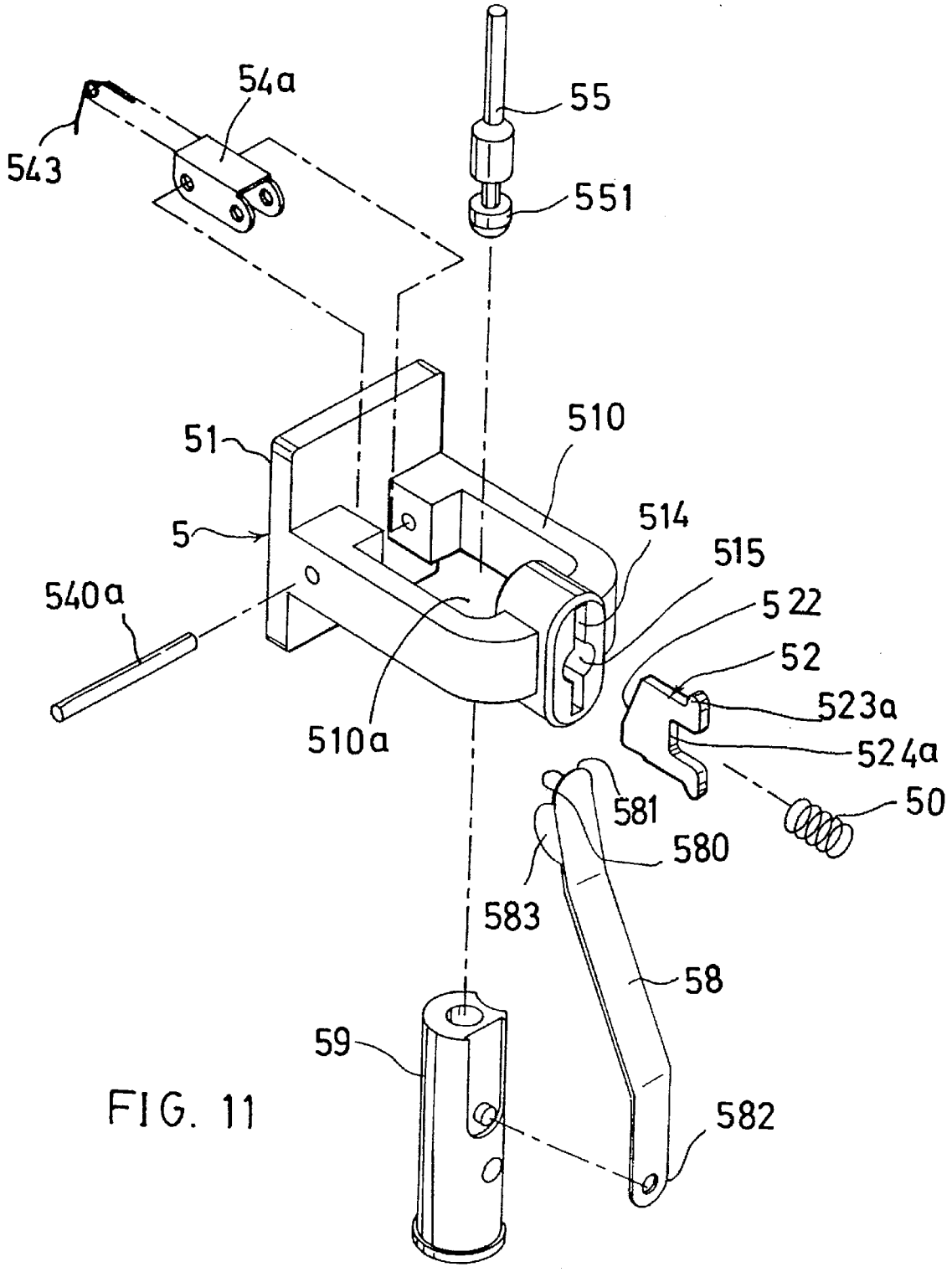
FIG. 11 is an exploded view showing the elements of the control means as shown in FIG. 9.

Another preferred embodiment of the present invention is shown in FIGS. 9–11, in which the control means 5 has been modified from the aforementioned to omit the safety means 57 and to modify the lower latch 54*a* to be pivotally secured to the push button 51.

The lower latch 54*a* includes: a pin 540*a* secured at a base portion of the slotted arm member 510 of the push button 51 for pivotally mounting the lower latch 54*a* at a middle inside portion of the button 51, a latch restoring spring 543 retained on the push button 51 for normally levelling the lower latch 54*a* to be generally perpendicular to the push button to allow an arcuate latch end 541 formed at an inner free end of the lower latch 54*a* to depress the locking head 551 to be disengaged from the detent protrusion 111*a* when closing (C) the umbrella (FIG. 10). The lower latch 54*a* is downwardly biased (B) by the bottom tube ends of the outer tube 14 and middle tube 13 when closing and resetting the umbrella for storing energy of the opening spring 3 as shown in FIG. 9, thereby allowing an inward depression of the push button 51 to open (O) the umbrella as shown in FIG. 9. Also, the downwardly biased (B) lower latch 54 will not depress the locking head 551 to prevent false operation for closing the umbrella.

The present invention may be modified without departing from the spirit and scope of this invention.

We claim:

1. An automatic umbrella comprising:

a central shaft means including: an inner tube, a grip secured with the inner tube, a middle tube slidably held on an outer and upper side of the inner tube, an outer tube slidably held on an outer and upper side of the middle tube, an upper notch secured on a top portion of the outer tube, and a central sleeve set having an inner and outer sleeve section telescopically held within said inner, middle and outer tubes;

a rib assembly including a plurality of ribs pivotally connected with one another and pivotally secured between the upper notch and a lower runner slidably held on said central shaft means;

an opening spring for opening an umbrella retained in said central shaft means and slidably disposed about the central sleeve set;

a plurality of closing springs respectively secured on said rib assembly for operatively closing an umbrella from an opened state by an elastic energy stored when opening the umbrella; and a control means including: a push button resiliently held in the grip, an upper latch slidably held in a slotted arm member perpendicularly protruding from a middle button portion of the push button from a first side of the central shaft means towards a second side of the shaft means and operatively depressed by the push button for opening the umbrella, a closing controller having a lower latch resiliently held in the grip and operatively depressible by the push button for inwardly pushing a locking head, which is secured with a drag rod coupled to a drag rope which is linked through the lower runner to an upper portion of the outer tube, for disengaging the locking head from a detent protrusion formed in a lower portion of the inner tube, thereby allowing each said closing spring to be restored to release a pre-stored elastic energy for closing the umbrella from an opened state, with the lower latch resiliently secured to an anti-false operation safety means which is lowered by the outer and middle tubes when closing the umbrella to prevent a false depression of the closing controller as depressed by the push button;

said upper latch including: a spring notch formed at the second side of the shaft means to be resiliently urged towards the first side of the shaft means by a restoring spring retained in the grip adjacent to the second side of the shaft means to be engageable with a lower hole in the outer tube, and a lower hole formed in the middle tube for locking an umbrella under a closed state; and said push button having the slotted arm member formed with a central hole in a central portion of the slotted arm member for downwardly passing a bottom tube portion of each said outer tube and said middle tube when folding the central shaft means for closing the umbrella, and a central thrusting block formed on a central portion inside the push button and protruding inwardly towards the second side of the shaft means;

the improvement which comprises:

said upper latch including: a pair of lugs protruding outwardly towards the second side of the central shaft means from a sloping latch portion to be engaged with two sockets formed in an inner portion of the slotted arm member of the push button, a latch slot formed through an inner end portion of the slotted arm member adjacent to the second side of said shaft means for slidably holding the sloping latch portion in the latch slot, whereby upon an inward depression of the push button to allow the two sockets of the slotted arm member of the push button to retract the two lugs of said upper latch for disengaging the sloping latch portion from the lower holes of the outer and middle tubes, the umbrella will be opened; and said convex spring plate having a lower spring end fixed to a plug inserted in the inner tube inserted into the inner hole of the grip, said convex spring plate having a pair of flaps disposed on two opposite side portions thereof for slidably holding the locking head to be locked on the detent protrusion when closing the umbrella.

2. An automatic umbrella comprising:

a central shaft means including: an inner tube, a grip secured with the inner tube, a middle tube slidably held on an outer and upper side of the inner tube, an outer tube slidably held on an outer and upper side of the middle tube, an upper notch secured on a top portion of the outer tube, and a central sleeve set having an inner and outer sleeve section telescopically held within said inner, middle and outer tubes;

a rib assembly including a plurality of ribs pivotally connected with one another and pivotally secured between the upper notch and a lower runner slidably held on said central shaft means;

an opening spring for opening an umbrella retained in said central shaft means and slidably disposed about the central sleeve set;

a plurality of closing springs respectively secured on said rib assembly for operatively closing an umbrella from an opened state by an elastic energy stored when opening the umbrella; and a control means including: a push button resiliently held in the grip, an upper latch slidably held in a slotted arm member perpendicularly protruding from a middle button portion of the push button from a first side of the central shaft means towards a second side of the shaft means and operatively depressed by the push button for opening the umbrella, a closing controller having a lower latch resiliently held in the grip and operatively depressible by the push button for inwardly pushing a locking head, which is secured with a drag rod coupled to a drag rope which is linked through the lower runner to an upper portion of the outer tube, for disengaging the locking head from a detent protrusion formed in a lower portion of the inner tube, for closing the umbrella from an opened state, and said lower latch including: a pin secured at a base portion of the slotted arm member of the push button for pivotally mounting the lower latch at a middle inside portion of the button, a latch restoring spring retained on the push button for normally levelling the lower latch to be generally perpendicular to the push button to allow an arcuate latch end formed at an inner free end of the lower latch to depress the locking head to be disengaged from the detent protrusion when closing the umbrella, said lower latch downwardly biased by each bottom tube end of the outer tube and middle tube when closing and resetting the umbrella for storing energy of the opening spring, thereby allowing an inward depression of the push button to open the umbrella;

said upper latch including: a spring notch formed at the second side of the shaft means to be resiliently urged towards the first side of the shaft means by a restoring spring retained in the grip adjacent to the second side of the shaft means to be engageable with a lower hole in the outer tube, and a lower hole formed in the middle tube for locking an umbrella under a closed state; and said push button having the slotted arm member formed with a central hole in a central portion of the slotted arm member for downwardly passing a bottom tube portion of each said outer tube and said middle tube when folding the central shaft means for closing the umbrella;

the improvement which comprises:

said upper latch including: a pair of lugs protruding outwardly towards the second side of the central shaft means from a sloping latch portion to be engaged with two sockets formed in an inner portion of the slotted arm member of the push button, and a latch slot formed through an inner end portion of the slotted arm member adjacent to the second side of said shaft means for slidably holding the sloping latch portion in the latch slot, whereby upon an inward depression of the push button to allow the two sockets of the slotted arm member of the push button to retract the two lugs of said upper latch for disengaging the sloping latch portion from the lower holes of the outer and middle tubes, the umbrella will be opened; and said convex spring plate having a lower spring end fixed to a plug inserted in the inner tube inserted into the inner hole of the grip, said convex spring plate having a pair of flaps disposed on two opposite side portions thereof for slidably holding the locking head to be locked on the detent protrusion when closing the umbrella.

* * * * *